US006402293B1

(12) United States Patent
Sawicki

(10) Patent No.: US 6,402,293 B1
(45) Date of Patent: Jun. 11, 2002

(54) VACUUM ACCUMULATOR AND INK MANIFOLD

(75) Inventor: Paul F. Sawicki, Rochester, NY (US)

(73) Assignee: Xerox Corp., Stamford, CT (US)

( * ) Notice: Subject to any disclaimer, the term of this patent is extended or adjusted under 35 U.S.C. 154(b) by 0 days.

(21) Appl. No.: 09/594,683

(22) Filed: Jun. 16, 2000

(51) Int. Cl.[7] ..... B41J 2/165
(52) U.S. Cl. ..... 347/36; 347/24
(58) Field of Search ..... 347/36, 24, 29, 347/30, 31, 100; B41J 2/165

(56) References Cited

U.S. PATENT DOCUMENTS

| | | | | | |
|---|---|---|---|---|---|
| 3,959,129 | A | * | 5/1976 | White et al. | 210/667 |
| 4,746,938 | A | | 5/1988 | Yamamori et al. | 347/28 |
| 4,853,717 | A | | 8/1989 | Harmon et al. | 347/29 |
| 4,855,764 | A | | 8/1989 | Humbs et al. | 347/31 |
| 5,151,715 | A | | 9/1992 | Ward et al. | 347/33 |
| 5,185,614 | A | * | 2/1993 | Courian et al. | 347/24 |
| 5,250,962 | A | | 10/1993 | Fisher et al. | 347/32 |
| 5,339,102 | A | | 8/1994 | Carlotta | 347/32 |
| 5,500,659 | A | | 3/1996 | Curran, Jr. et al. | 347/28 |
| 5,504,508 | A | * | 4/1996 | Hashimoto | 347/24 |
| 5,517,219 | A | * | 5/1996 | Uchida | 347/24 |
| 5,548,310 | A | | 8/1996 | Binnert et al. | 347/33 |
| 5,659,341 | A | | 8/1997 | Kinas | 347/33 |
| 5,680,162 | A | * | 10/1997 | Taylor et al. | 347/35 |
| 5,734,403 | A | * | 3/1998 | Suga et al. | 347/101 |
| 5,943,071 | A | | 8/1999 | Premnath | 347/33 |
| 6,050,671 | A | * | 4/2000 | Rotering | 347/35 |
| 6,062,672 | A | * | 5/2000 | Ishize et al. | 347/30 |
| 6,130,684 | A | | 10/2000 | Premnath et al. | 347/30 |
| 6,139,129 | A | * | 10/2000 | Tabasso et al. | 347/33 |

* cited by examiner

*Primary Examiner*—John Barlow
*Assistant Examiner*—Blaise Mouttet
(74) *Attorney, Agent, or Firm*—Oliff & Berridge, PLC

(57) ABSTRACT

A method and system for a vacuum and ink manifold usable in a maintenance station of an ink jet printer, including at least one printhead maintenance cap, a pump generating negative pressure, a waste accumulator, and a manifold. The waste accumulator is designed specifically for the combination of dye and pigment inks to maintain the combined waste ink in a transportable fluid state.

48 Claims, 3 Drawing Sheets

VACUUM ACCUMULATOR AND INK MANIFOLD

BACKGROUND OF THE INVENTION

1. Field of Invention

This invention relates to maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

This invention provides a vacuum accumulator and ink manifold usable with a maintenance station for an ink jet printer.

The printer has one or more printheads that are primed by a negative pressure created by a vacuum pump. Ink is drawn from the one or more printheads into one or more printhead caps of the maintenance station. In various exemplary embodiments, the one or more printheads eject both pigment-based inks and dye-based inks. The pigment-based and dye-based inks are drawn through the one or more maintenance caps and connecting tubing into an ink manifold. In the ink manifold, both the pigment-based and dye-based inks are mixed before the mixed ink flows out of the ink manifold and into a waste ink container. By mixing the pigment-based and dye-based inks in the ink manifold prior to pumping the mixed ink out of the ink manifold and into the waste ink container, the moisture level of the mixed ink remains high. By keeping the moisture level high, the likelihood of any clogging or stoppage due to increased viscosity, or in the extreme, drying and caking of the mixed in ink, is reduced.

These and other features and advantages of this invention are described in or are apparent from the following detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
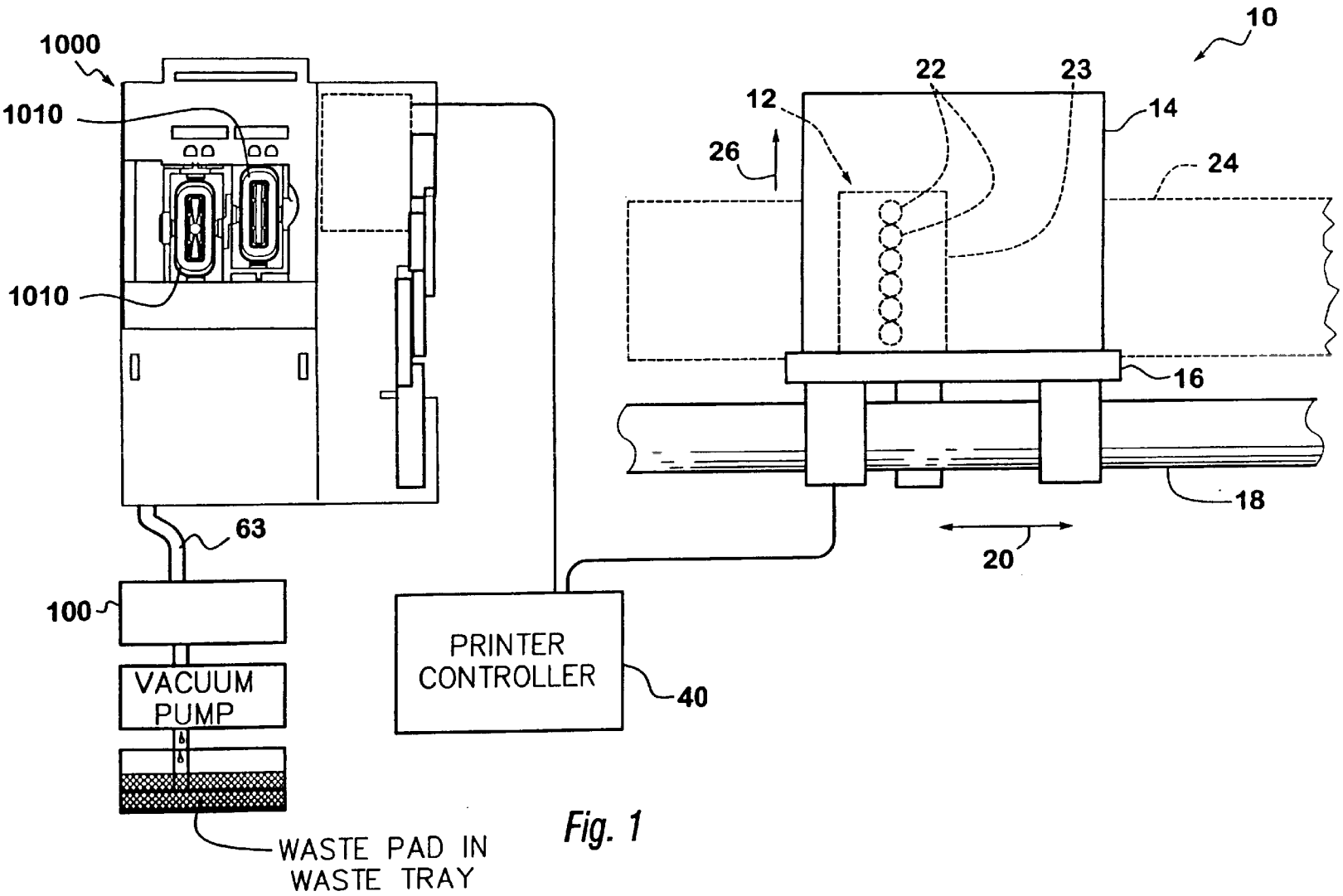
FIG. 1 is a schematic front elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of arrow 26 for the distance or the height of one printed swath. U.S. Pat. Nos. 4,571,599 and Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

As shown in FIG. 1, the maintenance station 1000 includes a one or more printhead caps 1010 that are engagable with the one or more printheads 12 to withdraw ink, debris and the like from the nozzles 22 of the one or more printheads 12. The waste ink withdrawn from the ink jet printheads 12 by the printhead caps 1010 are expelled or withdrawn from the maintenance station 1000 through one or more tubes 63 into a waste ink manifold 100 by a vacuum pump 300.

In various exemplary embodiments, the one or more printheads 12 eject both pigment-based inks and dye-based inks. One exemplary embodiment of a pigment-based ink is carbon-black based black ink. One exemplary embodiment of dye-based inks are the cyan, magenta and yellow colored inks commonly used in ink jet printers. However, it should be appreciated that the pigment-based and dye-based inks are not limited to these exemplary embodiments. It should also be appreciated that the printer can use a single printhead that ejects both pigment-based and dye-based inks, one or more printheads that eject only pigment-based inks with one or more printheads that eject only dye-based inks, or a one or more printheads, where each such printhead has a vast array of nozzles that eject only pigment-based inks, and another, spaced-apart array of nozzles that ejects only dye-based inks, or any combination of these or other types of printheads.

Figure 2:
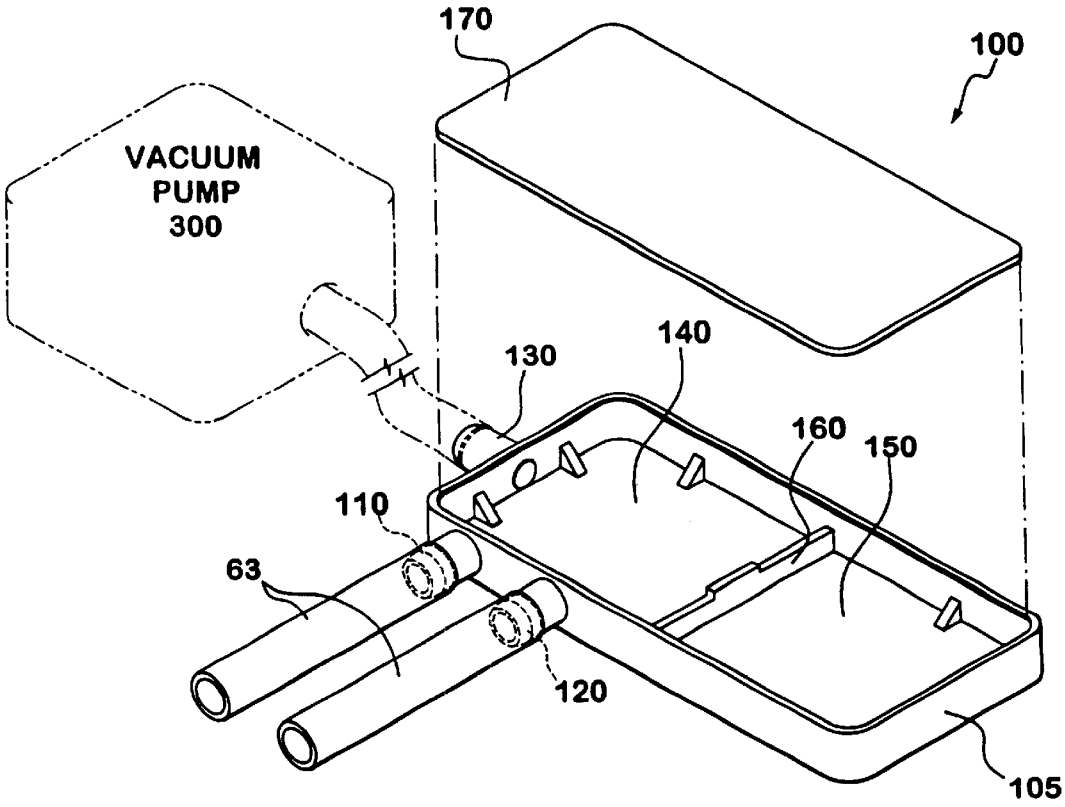
FIG. 2 is an exploded, perspective view of a first exemplary embodiment of a vacuum accumulator and ink manifold according to this invention.
Figure 3:
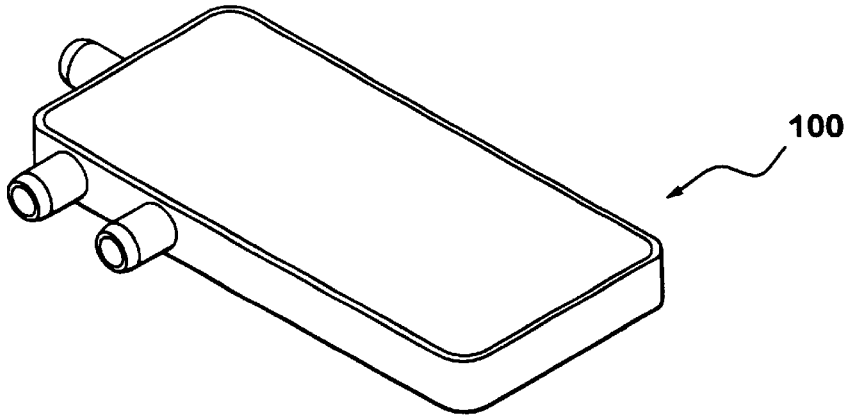
FIG. 3 is a perspective view, with the cover in place, of the vacuum accumulator and ink manifold of FIG. 4.

FIGS. 2 show a perspective view of a first exemplary embodiment of a waste ink manifold 100 according to this invention. In FIG. 3, a top of the waste ink manifold 100 surface 170 has been removed. The waste ink manifold 100 has two bottom surfaces 140 and 150, a top surface 170, a side surface 105 and a series of internal supports 160. In addition, the waste ink manifold 100 has two inlet ports 110 and 120 and one outlet port 130. The waste ink manifold 100 serves to add an additional volume, when necessary, to assist the active impulse vacuum which drives the ink flow through the maintenance station 1000 and out the one or more tubes.

An active impulse vacuum from the vacuum pump 300 drives the ink flow through the maintenance station 1000 and out through the one or more tubes 63. Although a specific length is not critical for the one or more tubes 63 in various exemplary embodiments, a relative volume ratio of 3 to 1 between the volume of the tubing 63 and the waste ink accumulator 100 to a pinch portion on the tubes 63 from the maintenance station 1000 to the volume of the tubes 63 and the one or more printhead caps 1010 from the pinch point should be maintained in order to maintain adequate priming of the printhead. That is, the volume between the vacuum pump 300 and the pinch point including the volume of the tubes 63 and the waste ink accumulator 100 should be three times the volume between the pinch point and printhead caps including the volumes of the tubes 63 and the printhead caps 1010. Therefore, the closer that the vacuum pump 300 is moved to the maintenance station 1000, which reduces the relative length of the tubes 63 downstream of the pinch point, the larger the volume provided by the waste ink manifold 100 must be. In addition, the ink outflow from the maintenance station 1000 that is contained in the one or more tubes 63, may be combined through a Y-channel connector before reaching the waste ink manifold 100. Alternatively, the ink outflow from the maintenance station 1000 may be communicated to the waste ink manifold 100 without using the Y-channel connector between the maintenance station 100 and the waste ink manifold 100. In any case, with or without the Y-channel connector, the appropriate lengths of the one or more tubes 63 and their relative flow volumes must be taken into consideration to maintain an active impulse vacuum in order to adequately prime the printhead 12. This will also provide adequate ink flow through the printhead caps 1010 to the waste ink manifold.

Optionally, a manual prime button (not shown) is provided on the printer for actuation by a printer operator when the printer operator notices poor print quality caused by, for example, a nozzle that is not ejecting ink droplets. This manual priming activated by the manual prime button works substantially the same way as the automatic prime sequence described above, which is generally performed when the print cartridge is installed or any other sensed event which is programmed into the printer controller. The only difference is that the amount of lapse time is reduced after the pinch valve is opened to reduce the amount of waste ink sucked from the print cartridge and prevent reduced printing capacity per print cartridge. Occasionally, a manual refresh prime may not be sufficient to improve print quality. Therefore, the user or the printer controller 40 can invoke the initial prime procedures after one or more attempts using the manual refresh prime were made. For example, after two consecutive manual refresh prime attempts within a two minute period, the third attempt would be made by the printer controller at using the initial prime procedure.

After priming the one or more printheads 12, waste ink tends to be left in the flowpath between the one or more cap 600 and the ultimate receptacle for the waste ink. As indicated above, this flowpath includes the one or more cap 600, the one or more tubes 63, the waste ink accumulator 100 and the pump 300. During the time the waste ink remains in the flowpath between the one or more printhead caps 1010 and the ultimate waste ink receptacle, the volume liquid components of the pigment-based inks tend to evaporate. In other words, the pigment-based inks become more viscous. This makes transporting such pigment-based inks to the ultimate waste receptacle very difficult, or even impossible if a long period of time has passed. The waste ink accumulator 100 according to this invention avoids this problem by ensuring that all of the waste ink flows out of the printhead caps 1010 and through the one or more tubes 63 into the waste accumulator 100. In particular, because both the pigment-based inks and the dye-based inks flow into the single waste accumulator 100 through the ports 110 and 120, the pigment-based inks and the dye-based inks tend to combine in the waste ink accumulator 100. By combining the two different types of inks, the combined or mixed pigment-based and dye-based ink, due to the additional fluids in the dye-based inks, tends to keep the combined waste ink in the waste ink accumulator 100 in a transportable fluid state. In particular, in various exemplary embodiments, the dye-based inks are water-based inks. Thus, the combined waste ink in the waste ink accumulator 100 tends to remain in the transportable aqueous solution. Because of the additional fluids in the combined ink, the combined or mixed ink does not dry out and is easily able to pass from the waste ink accumulator 100 and into the ultimate waste ink receptacle.

A baffle 160 is provided in the waste accumulator 100, to ensure that a portion of the manifold is void of ink for the next prime cycle. In the event that some quantity of ink was not evacuated from the manifold, the baffle 160 provides an air pocket to provide the volume needed to stay as close to the 3:1 ratio required and described above.

In the first exemplary embodiment of the waste ink receptacle shown in FIGS. 2 and 3, the one or more tubes 63 from the maintenance station 1000 comprises two tubes 63, each connected to one of the maintenance caps 1010. In particular, these two tubes 63 are connected directly to the waste ink accumulator 100 through the ports 110 and 120.

Figure 4:
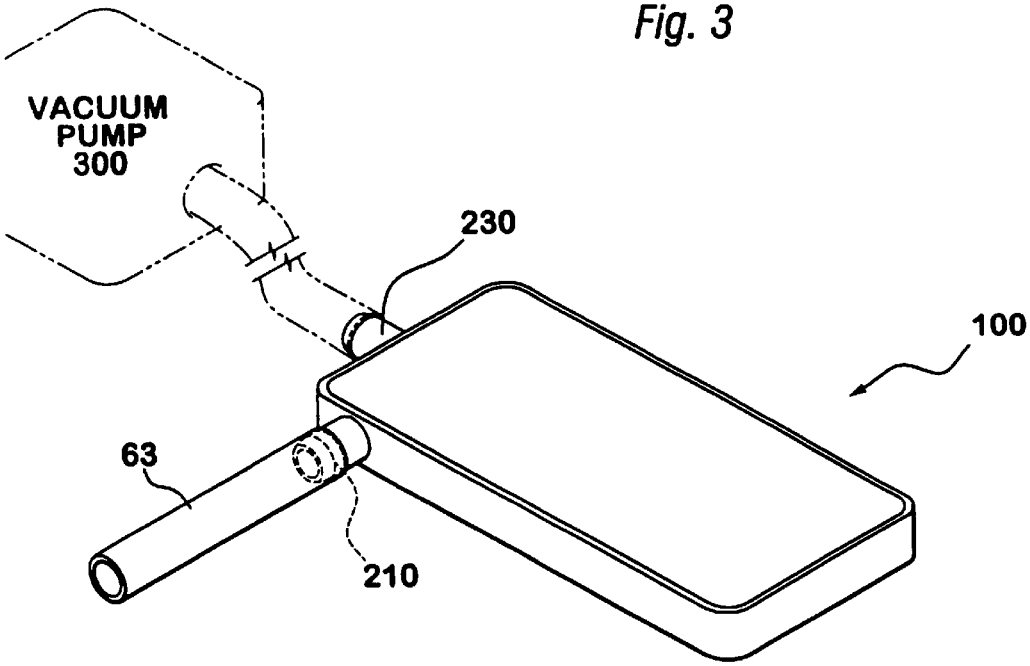
FIG. 4 is a perspective view of a second exemplary embodiment, with the cover in place, of the vacuum accumulator and ink manifold according to this invention.

FIG. 4 shows a second exemplary embodiment of the waste ink accumulator 200 according to this invention. In the waste ink accumulator 200, the multiports 110 and 120 incorporated into the waste accumulator 100 and connected by the multiple tubes 63 to the multiple printhead caps 1010 are replaced with a single inlet port 210 and one outlet port 230. This single inlet port 210 is connected to a single tube 63. The other end of this single tube 63 is connected to the outlet port of a multiple inlet port connector. The multiple inlet ports of the multiple inlet port connector are connected by the multiple tubes 63 of the maintenance station to the multiple printhead caps 1010. One exemplary embodiment of a multiple inlet port connector is the Y-connector described above. One exemplary embodiment of the Y-connector when used with the maintenance station 1000 is described in greater detail in U.S. patent application Ser. No. 09/594,680 herewith an incorporated herein by reference in its entirety.

While this invention has been described in conjunction with the exemplary embodiments outlined above, it is evident that many alternatives, modifications and variations will be apparent to those skilled in the art. Accordingly, the exemplary embodiments of the invention as set forth above are intended to be illustrative, not limiting. Various changes may be made without departing from the spirit and scope of the invention.

What is claimed is:

1. A vacuum applying system usable in an ink jet printer having a first printhead portion that ejects at least one pigment-based ink and a second printhead portion that ejects at least one dye-based ink, comprising:

at least one printhead maintenance cap usable to receive waste ink from the first and second printhead portions;

a pump generating a negative pressure;

a waste ink accumulator designed specifically for the combination of dye and pigment inks to maintain the combined waste ink in a transportable fluid state and creating an additional containment volume to assist the pump and having at least one input port and an output port;

a first section of tubing that connects the output port of the waste ink accumulator to the pump to communicate the negative pressure to the accumulator; and at least one second section of tubing, the at least one second section of tubing connecting the at least one printhead maintenance cap to the at least one input port of the ink waste accumulator;

wherein pigment-based waste ink and dye-based waste ink received by the at least one printhead maintenance cap from the first and second printhead portions is drawn into the waste ink accumulator by the negative pressure through the at least one second section of tubing, such that the pigment-based and dye-based waste inks are present in the waste ink accumulator in a combined form.

2. The vacuum applying system of claim 1, wherein one of the first and second printhead portions comprises at least one subset of nozzles of a single printhead.

3. The vacuum applying system of claim 2, wherein the first and second printhead portions each comprises at least one subset of nozzles of the single printhead.

4. The vacuum applying system of claim 3, wherein the first printhead portion comprises a plurality of subsets of nozzles of the single printhead, each subset of nozzles ejecting a differently colored ink.

5. The vacuum applying system of claim 4, wherein the at least one maintenance cap comprises a plurality of maintenance caps, each maintenance cap capping one of subsets of nozzles of the first and second printhead portions.

6. The vacuum applying system of claim 5, wherein:

the at least one input port comprises a plurality of input ports;

the at least one second section of tubing comprises a plurality of second sections of tubing; and for each second section of tubing, that second section of tubing connects one of the plurality of maintenance caps to one of the plurality of input ports, the pigment-based inks and the dye-based ink combining in the waste ink accumulator.

7. The vacuum applying system of claim 5, further comprising a tubing connector having a plurality of input ports and output port, wherein:

the at least one input port comprises one input port;

the at least one second section of tubing comprises a plurality of second sections of tubing; and for each second section of tubing, that second section of tubing connects one of the plurality of maintenance caps to one of the plurality of input ports of the tubing connector or connects the output port of the tubing connector to the input port of the waste ink accumulator, the pigment-based inks and the dye-based ink at least partially combining in the waste ink accumulator.

8. The vacuum applying system of claim 5, wherein:

the at least one input port comprises one input port;

the at least one second section of tubing comprises one second section of tubing; and the second section of tubing connects the maintenance cap to the input ports, the pigment-based inks and the dye-based ink at least partially combining in the waste ink accumulator.

9. The vacuum applying system of claim 3, wherein the second printhead portion comprises a plurality of subsets of nozzles of the single printhead, each subset of nozzles ejecting a differently colored-ink.

10. The vacuum applying system of claim 2, wherein the at least one maintenance cap comprises a single maintenance cap that caps the first and second printhead portions.

11. The vacuum applying system of claim 2, wherein the at least one maintenance cap comprises a plurality of maintenance caps, each maintenance cap capping one of the first and second printhead portions.

12. The vacuum applying system of claim 11, wherein:

the at least one input port comprises a plurality of input ports;

the at least one second section of tubing comprises a plurality of second sections of tubing; and for each second section of tubing, that second section of tubing connects one of the plurality of maintenance caps to one of the plurality of input ports, the pigment-based inks and the dye-based ink combining in the waste ink accumulator.

13. The vacuum applying system of claim 11, further comprising a tubing connector having a plurality of input ports and output port, wherein:

the at least one input port comprises one input port;

the at least one second section of tubing comprises a plurality of second sections of tubing; and for each second section of tubing, that second section of tubing connects one of the plurality of maintenance caps to one of the plurality of input ports of the tubing connector or connects the output port of the tubing connector to the input port of the waste ink accumulator, the pigment-based inks and the dye-based ink at least partially combining in the waste ink accumulator.

14. The vacuum applying system of claim 1, wherein one of the first and second printhead portions comprises a first printhead and the other of the first and second printhead portion comprises at least one subset of nozzles of a second printhead.

15. The vacuum applying system of claim 14, wherein the at least one maintenance cap comprises a plurality of maintenance caps, each maintenance cap capping one of the first and second printheads.

16. The vacuum applying system of claim 15, wherein:

the at least one input port comprises a plurality of input ports;

the at least one second section of tubing comprises a plurality of second sections of tubing; and for each second section of tubing, that second section of tubing connects one of the plurality of maintenance caps to one of the plurality of input ports, the pigment-based inks and the dye-based ink combining in the waste ink accumulator.

17. The vacuum applying system of claim 15, further comprising a tubing connector having a plurality of input ports and output port, wherein:

the at least one input port comprises one input port;

the at least one second section of tubing comprises a plurality of second sections of tubing; and for each second section of tubing, that second section of tubing connects one of the plurality of maintenance caps to one of the plurality of input ports of the tubing connector or connects the output port of the tubing connector to the input port of the waste ink accumulator, the pigment-based inks and the dye-based ink at least partially combining in the waste ink accumulator.

18. The vacuum applying system of claim 14, wherein the first printhead portion comprises a plurality of subsets of nozzles of the second printhead, each subset of nozzles ejecting a differently colored ink.

19. The vacuum applying system of claim 14, wherein the second printhead portion comprises a plurality of subsets of nozzles of the second printhead, each subset of nozzles ejecting a differently colored ink.

20. The vacuum applying system of claim 14, wherein the at least one maintenance cap comprises a plurality of maintenance caps, each maintenance cap capping the first print head or one of subsets of nozzles of the second printhead portion.

21. The vacuum applying system of claim 20, wherein:

the at least one input port comprises a plurality of input ports;

the at least one second section of tubing comprises a plurality of second sections of tubing; and for each second section of tubing, that second section of tubing connects one of the plurality of maintenance caps to one of the plurality of input ports, the pigment-based inks and the dye-based ink combining in the waste ink accumulator.

22. The vacuum applying system of claim 20, further comprising a tubing connector having a plurality of input ports and output port, wherein:

the at least one input port comprises one input port;

the at least one second section of tubing comprises a plurality of second sections of tubing; and for each second section of tubing, that second section of tubing connects one of the plurality of maintenance caps to one of the plurality of input ports of the tubing connector or connects the output port of the tubing connector to the input port of the waste ink accumulator, the pigment-based inks and the dye-based ink at least partially combining in the waste ink accumulator.

23. The vacuum applying system of claim 1, wherein the first and second printhead portions comprise a plurality of physically distinct printheads.

24. The vacuum applying system of claim 23, wherein the first printhead portion comprises at least a first printhead, and the second printhead portion comprises at least a second printhead.

25. The vacuum applying system of claim 24, wherein the first printhead portion comprises a plurality of subsets of nozzles of the first printhead, each subset of nozzles ejecting a differently colored ink.

26. The vacuum applying system of claim 25; wherein the second printhead portion comprises the second printhead, the second printhead ejecting a single color of ink.

27. The vacuum applying system of claim 24, wherein the second printhead portion comprises at least the second printhead and a third printhead.

28. The vacuum applying system of claim 27, wherein each of at least the second and third printheads ejects a different color of ink.

29. The vacuum applying system of claim 27, wherein the second and at least the third printheads eject a same color of ink.

30. The vacuum applying system of claim 24, wherein the second printhead portion comprises a plurality of subsets of nozzles of the second printhead, each subset of nozzles ejecting a differently colored ink.

31. The vacuum applying system of claim 30, wherein the first printhead portion comprises the first printhead, the first printhead ejecting a single color of ink.

32. The vacuum applying system of claim 24, wherein the second printhead portion comprises at least the first printhead and a third printhead.

33. The vacuum applying system of claim 32, wherein each of at least the first and third printheads ejects a different color of ink.

34. The vacuum applying system of claim 32, wherein the second and at least the third printheads eject a same color of ink.

35. The vacuum applying system of claim 34, wherein the at least one maintenance cap comprises a plurality of maintenance caps, each maintenance cap capping one of the plurality of printheads.

36. The vacuum applying system of claim 35, wherein:

the at least one input port comprises a plurality of input ports;

the at least one second section of tubing comprises a plurality of second sections of tubing; and for each second section of tubing, that second section of tubing connects one of the plurality of maintenance caps to one of the plurality of input ports, the pigment-based inks and the dye-based ink combining in the waste ink accumulator.

37. The vacuum applying system of claim 35, further comprising a tubing connector having a plurality of input ports and output port, wherein:

the at least one input port comprises one input port;

the at least one second section of tubing comprises a plurality of second sections of tubing; and for each second section of tubing, that second section of tubing connects one of the plurality of maintenance caps to one of the plurality of input ports of the tubing connector or connects the output port of the tubing connector to the input port of the waste ink accumulator, the pigment-based inks and the dye-based ink at least partially combining in the waste ink accumulator.

38. The vacuum applying system of claim 1, wherein, in waste ink accumulator, the combined waste ink is stored as a fluid solution, the combined ink remaining in the fluid solution in the waste ink accumulator.

39. An maintenance station usable with an ink jet printer having a first printhead portion that ejects at least one pigment-based ink and a second printhead portion that ejects at least one dye-based ink, comprising:

at least one ink jet maintenance mechanism; and the vacuum applying system of claim 1.

40. An ink jet printer, comprising:

a first printhead portion that ejects at least one pigment-based ink;

a second printhead portion that ejects at least one dye-based ink; and the vacuum applying system of claim 1.

41. A vacuum applying system usable with an ink jet printer having a first printhead portion that ejects at least one pigment-based ink and a second printhead portion that ejects at least one dye-based ink, comprising:

at least one printhead maintenance cap usable to receive waste ink from the first and second printhead portions;

a waste ink accumulator designed specifically for the combination of dye and pigment inks to maintain the combined waste ink in a transportable fluid state and creating an additional containment volume to assist the vacuum created through the system; and at least one fluid path that connects the at least one printhead maintenance cap to the waste ink accumulator;

wherein pigment-based waste ink and dye-based waste ink received by the at least one printhead maintenance cap from the first and second printhead portions is accumulated in the waste ink accumulator through the at least one fluid path, such that the pigment-based and dye-based waste inks are present in the waste accumulator in a combined form.

42. The vacuum applying system of claim 41, wherein:

the at least one printhead maintenance cap comprises a single printhead maintenance cap; and the at least one fluid path comprises a single fluid path that directly connects the single printhead maintenance cap to the accumulator.

43. The vacuum applying system of claim 41, wherein:

the at least one maintenance cap comprises a plurality of printhead maintenance caps; and the at least one fluid path comprises a plurality of fluid paths;

wherein, for each fluid path, that fluid path directly connects a corresponding printhead maintenance cap to the accumulator.

44. The vacuum applying system of claim 41, wherein the at least one fluid path comprises:

for each printhead maintenance cap, a first fluid path portion that connects that printhead maintenance cap to an input port of a fluid path connector; and a second fluid path that connects an output port of the fluid path connector to an input port of the waste ink accumulator.

45. The vacuum applying system of claim 41, wherein:

the at least one fluid path comprises a plurality of fluid paths; and the plurality of fluid paths combine at the waste ink accumulator.

46. The vacuum applying system of claim 41, wherein:

the at least one fluid path comprises a plurality of fluid paths; and the plurality of fluid paths at least partially combine before entering the waste ink accumulator.

47. An maintenance station usable with an ink jet printer having a first printhead portion that ejects at least one pigment-based ink and a second printhead portion that ejects at least one dye-based ink, comprising:

at least one ink jet maintenance mechanism; and the vacuum applying system of claim 41.

48. An ink jet printer, comprising:

a first printhead portion that ejects at least one pigment-based ink;

a second printhead portion that ejects at least one dye-based ink; and the vacuum applying system of claim 41.

* * * * *